US008021167B2

(12) United States Patent
Hantschel et al.

(10) Patent No.: US 8,021,167 B2
(45) Date of Patent: Sep. 20, 2011

(54) 'ALL IN ONE' SPRING PROCESS FOR COST-EFFECTIVE SPRING MANUFACTURING AND SPRING SELF-ALIGNMENT

(75) Inventors: Thomas Hantschel, Menlo Park, CA (US); David K. Fork, Los Altos, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 0 days.

(21) Appl. No.: 12/695,124

(22) Filed: Jan. 27, 2010

(65) Prior Publication Data

US 2010/0140858 A1 Jun. 10, 2010

Related U.S. Application Data

(62) Division of application No. 11/512,877, filed on Aug. 29, 2006, now Pat. No. 7,685,709.

(51) Int. Cl.
*H01R 9/09* (2006.01)

(52) U.S. Cl. ..... 439/81

(58) Field of Classification Search ..... 439/527, 439/828, 786, 789, 834, 835, 440, 439
See application file for complete search history.

(56) References Cited

U.S. PATENT DOCUMENTS

| | | | | |
|---|---|---|---|---|
| 5,613,861 | A * | 3/1997 | Smith et al. | 439/81 |
| 5,944,537 | A | 8/1999 | Smith et al. | |
| 6,184,065 | B1 | 2/2001 | Smith et al. | |
| 6,290,510 | B1 | 9/2001 | Fork et al. | |
| 6,499,216 | B1 | 12/2002 | Fjelstad | |
| 6,528,350 | B2 | 3/2003 | Fork | |
| 6,658,728 | B2 | 12/2003 | Fork et al. | |
| 6,815,961 | B2 | 11/2004 | Mok et al. | |
| 6,973,722 | B2 | 12/2005 | Hantschel et al. | |
| 7,006,720 | B2 | 2/2006 | Dunec et al. | |
| 7,048,548 | B2 | 5/2006 | Mathieu et al. | |
| 7,082,684 | B2 | 8/2006 | Hantschel et al. | |
| 7,230,440 | B2 | 6/2007 | Hantschel et al. | |
| 2002/0013070 | A1 | 1/2002 | Fork et al. | |
| 2006/0105122 | A1 * | 5/2006 | Hantschel et al. | 428/34.1 |

OTHER PUBLICATIONS

Kataoka et al.: "Low Contact-Force and Compliant MEMS Probe Card Utilizing Fritting Contact", IEEE Proceedings of Micro Electro Mechanical Systems (MEMS) 2002, pp. 364-367.

* cited by examiner

*Primary Examiner* — Alexander Gilman
(74) *Attorney, Agent, or Firm* — Bever, Hoffman & Harms, LLP; Patrick T. Bever

(57) ABSTRACT

A method of forming spring structures using a single lithographic operation is described. In particular, a single lithographic operation both defines the spring area and also defines what areas of the spring will be uplifted. By eliminating a second lithographic operation to define a spring release area, processing costs for spring fabrication can be reduced.

8 Claims, 11 Drawing Sheets

'ALL IN ONE' SPRING PROCESS FOR COST-EFFECTIVE SPRING MANUFACTURING AND SPRING SELF-ALIGNMENT

RELATED APPLICATIONS

This application is a divisional of U.S. patent application Ser. No. 11/512,877, entitled "'All In One' Spring Process For Cost-Effective Spring Manufacturing And Spring Self-Alignment" filed Aug. 29, 2006.

BACKGROUND

Stressed metal devices have become increasingly important for fabricating interconnects, probes, inductors and the like. However, fabrication of the stressed metal devices is a difficult and expensive process. One reason for the extra expense is the use of multiple lithography steps.

Prior art spring formation techniques typically use at least two lithography operations. A first lithography operation patterns a stressed or bimorph metal to form a general spring structure. A second lithography operation defines a spring release area (the release area is defined as the region that uplifts from a substrate). The second lithography operation may also be used to plate additional metal onto the stressed metal spring. A detailed description of the entire process is provided in U.S. Pat. No. 6,528,350 which is hereby incorporated by reference in its entirety.

These two basic lithographic operations have remained the same for about ten years. The cost associated with two lithographic operations has kept spring interconnect technology more expensive then some competing interconnect technologies. Thus a more efficient and thus less expensive way of fabricating a stressed metal device is needed.

SUMMARY

A method of making a spring structure with only a single lithographic operation is described. The method includes the operations of depositing a release layer over a substrate. A resist pattern is formed over the release layer and a spring material deposited in an opening in the resist. The spring material includes an internal stress gradient. After deposition of the spring material, the resist and spring material are exposed to an etchant that penetrates an interface between the resist and spring material. The etchant etches the release layer under a release portion of the spring material to allow a release area of the spring to curl out of the plane of the substrate.

DETAILED DESCRIPTION

A method of creating a stressed metal spring structure using a single lithographic operation will be described. The spring structures are typically used to interconnect circuit devices such as integrated circuits. As used herein, stressed metal is defined as a spring structure with an internal stress gradient typically formed by the deposition of multiple sublayers, each sublayer deposited at a different a different temperature or pressure such that the density in each sublayer is different resulting in an the internal stress gradient. A detailed description of forming a stressed metal spring is provided in U.S. Pat. No. 6,528,350 entitled "Method for Fabricating a Metal Plated Spring Structure" by David Fork which is hereby incorporated by reference.

Figure 1:
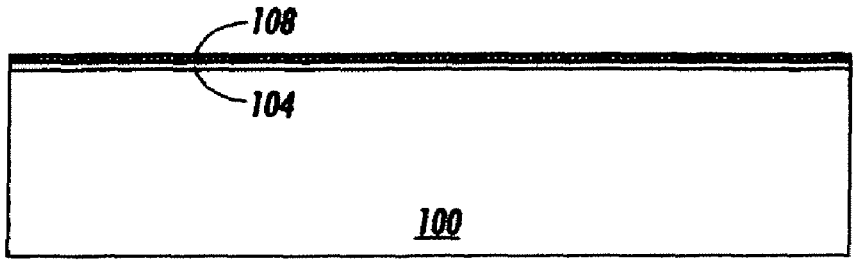
FIGS. 1-9 show a side cross sectional view of the operations involved in forming a stressed metal spring using a single lithographic operation.

FIGS. 1-9 provide a schematic side view of a one lithography operation or an "all-in-one" process for forming a stressed metal spring. In FIG. 1, a release layer 104 and a seed layer 108 are deposited over a substrate 100. Release layer 104 is selected to be a material that can be easily etched to "release" a spring that will be subsequently deposited over the release layer. In one embodiment, release layer 104 is a sputtered titanium (Ti) layer.

Seed layer 108 is deposited over the release layer. Seed layer 108 facilitates growth or deposition of masking materials (typically a resist) and spring materials deposited over seed layer 108. An example seed layer is a gold (Au) layer deposited by sputtering techniques.

It is sometimes advantageous to combine release layer 104 and seed layer 108 into a single layer or use a single material for both layers. Combining the two layers reduces the number of deposition operations during fabrication. Examples of a combined seed/release layer are titanium (Ti), copper (Cu) and nickel (Ni) deposited in a single layer over substrate 100.

Figure 2:
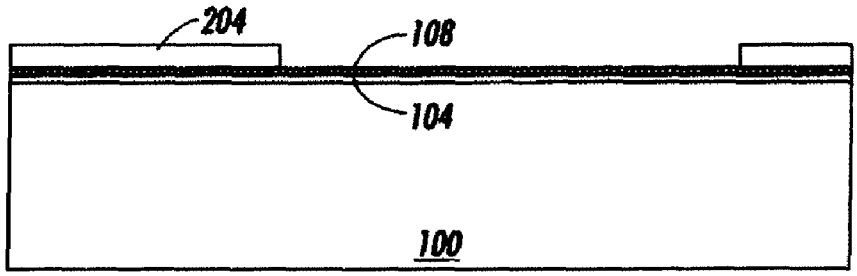

In FIG. 2, a lithographic process is used to deposit a mask, typically a hard mask, such as a resist 204. Resist 204 may be any common commercial photoresist used in semiconductor processing. A method of using this same resist mask for spring patterning, release and overplating will be described. Multiple use of the same mask reduces fabrication cost. Cost reductions arise from both mask count reductions and also elimination of resist spinning, baking developing, exposing and stripping associated with additional maskings.

Figure 3:
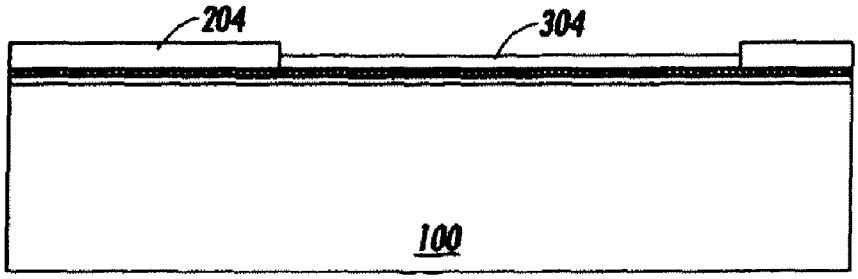
Figure 4:
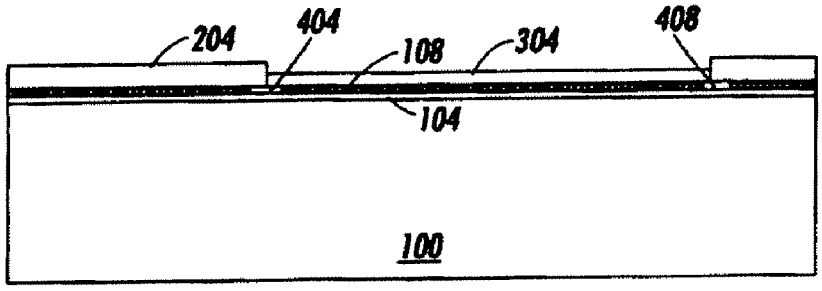

In FIG. 3, a spring material 304 is deposited in a resist material 204 opening. In one embodiment, spring material 304 is a nickel (Ni) plating deposited in a plurality of sublayers to create an internal stress gradient. Electroless or electroplating techniques may be used to deposit the spring material. In one embodiment, the built in stress gradient is obtained by plating from two baths with different stress characteristics or by varying the current density during plating. A detailed description of forming such stress gradients is provided in Kenichi Kataoka, Shingo Kawamura, Toshihiro Itoh, Tadatomo Suga, "Low contact-force and compliant MEMS probe card utilizing fritting contact," IEEE Proceedings of Micro Electro Mechanical Systems (MEMS) 2002, pp. 364-367, 2002 which is hereby incorporated by reference.

Although FIG. 3 shows a stressed metal spring material, it should be understood that the spring material is not limited to stressed metals. For example, a bimorph or bimetallic material may be used. Temperature or other parameter changes induce stresses in the bimorph or bimetallic material causing the spring release portion to curl out of the plane of the resist.

After spring material deposition, the entire structure is exposed to a series of interface penetrating etches. The etchant penetrates interface 404, 408 between spring material 304 and resist material 204. The first etchant removes portions of the seed layer near interfaces 404 and 408. In one example, the seed layer is a gold layer, and a typical etchant is an etchant containing potassium iodide (KI) and iodide (I).

Figure 5:
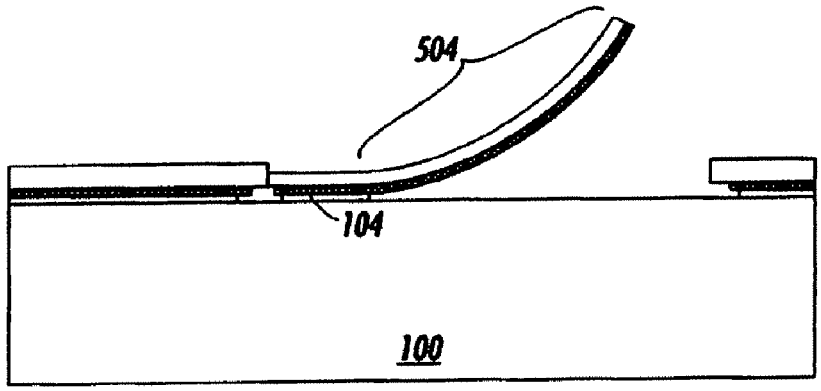

In FIG. 5, a second interface penetrating etchant follows the seed layer etch. The second interface penetrating etch etches release layer 104. In one example, the release layer is a titanium layer and the second interface penetrating etchant is hydrofluoric acid (HF) or buffered hydrofluoric acid (BHF). The release layer etch starts from the interface region and laterally etches outward from interfaces 404 and 408. Over time, the etchant removes most or all of the release layer underneath a release portion 504 of the spring material. The release layer removal allows the spring release portion 504 to uplift out of the plane in which it was deposited.

Although the preceding has been described as a two step operation of first etching a seed layer followed by etching of a release layer, it should be understood that the seed layer and the release layer may be combined into a single layer as previously described. When the seed layer and resist layer are combined, a single etchant solution penetrates the spring material/resist interface and etches the combination seed/release layer.

Figure 6:
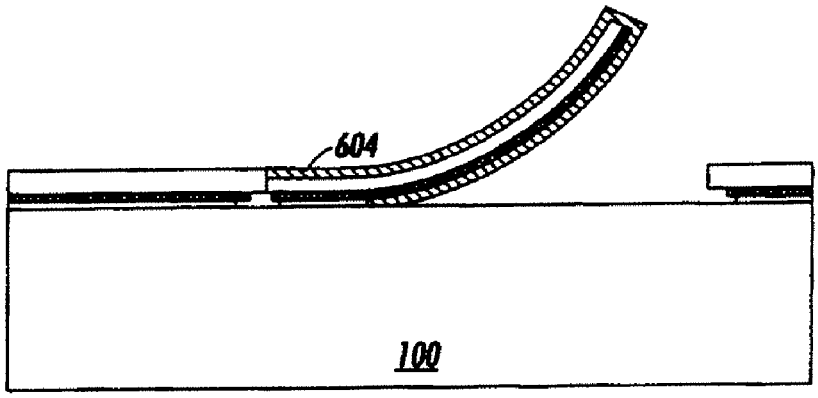

FIGS. 6-9 show optional spring material treatments to further enhance spring performance. FIG. 6, shows an example of spring overplating with a cladding layer 604. Example spring overplating materials include NiP plating, NiP+Au plating, or Cu+NiP+Au plating. The particular plating chosen depends on the spring characteristics desired which usually depends on how the spring will be used. Spring characteristics improved by plating include spring conductivity, hardness, wear resistance and stiffness.

Figure 7:
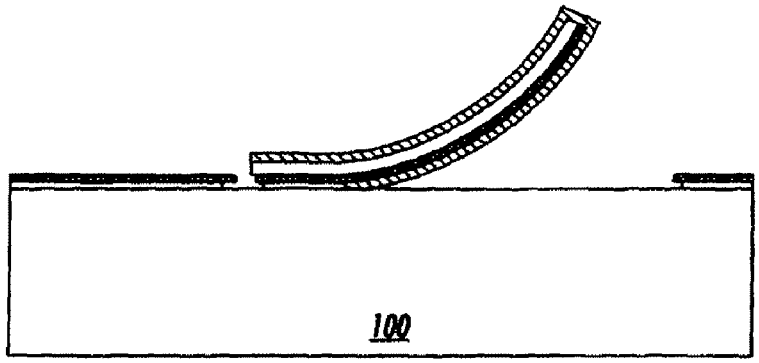
Figure 8:
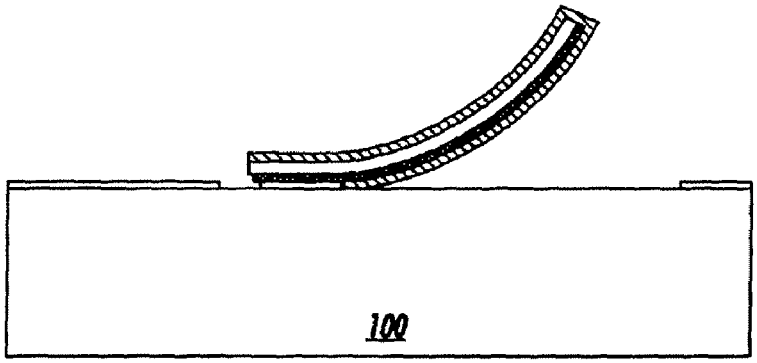
Figure 9:
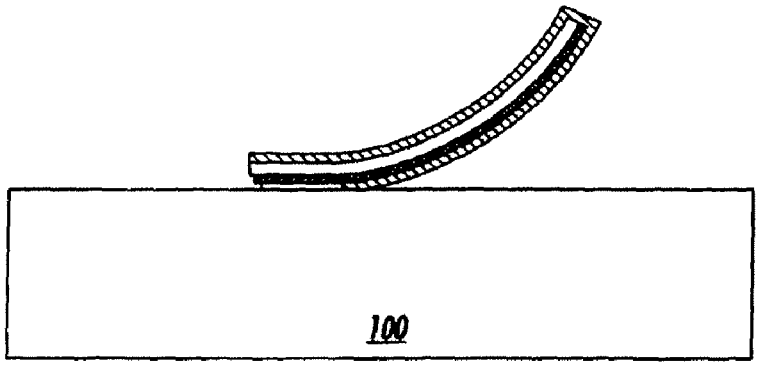

In FIG. 7 remaining resist is stripped or otherwise removed. FIG. 8 shows the removal of the seed layer and FIG. 9 shows the removal of the release layer. A clear-etch containing potassium iodide (KI) and iodide (I) is one common method for removing a gold (Au) seed layer. A clear-etch containing hydrofluoric acid (HF) is one common method for removing a titanium (Ti) release layer.

Figure 11:
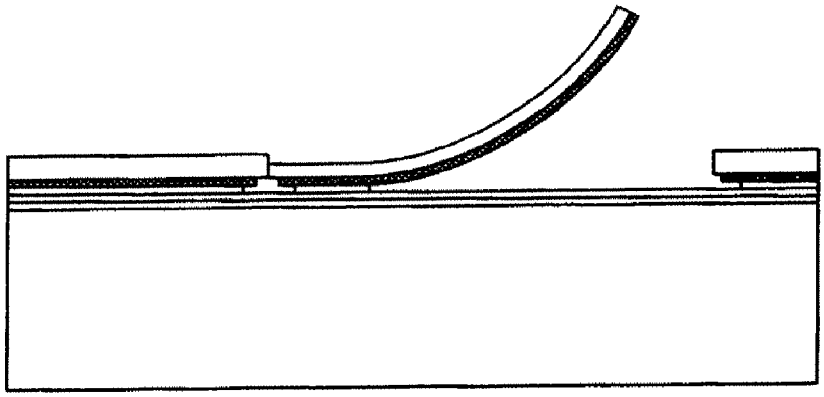
Figure 12:
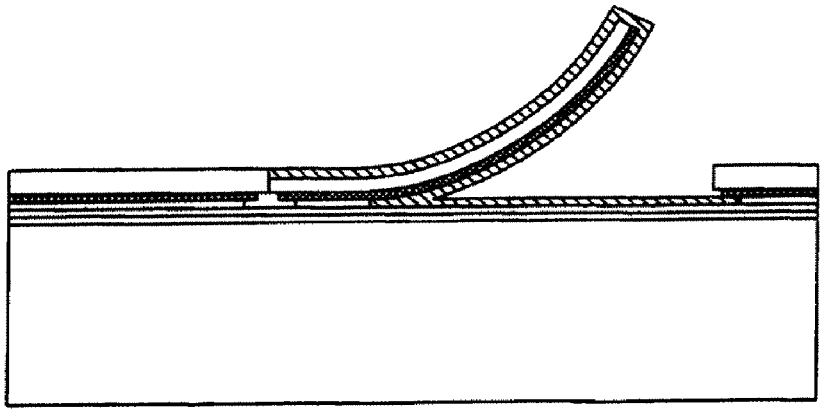
Figure 13:
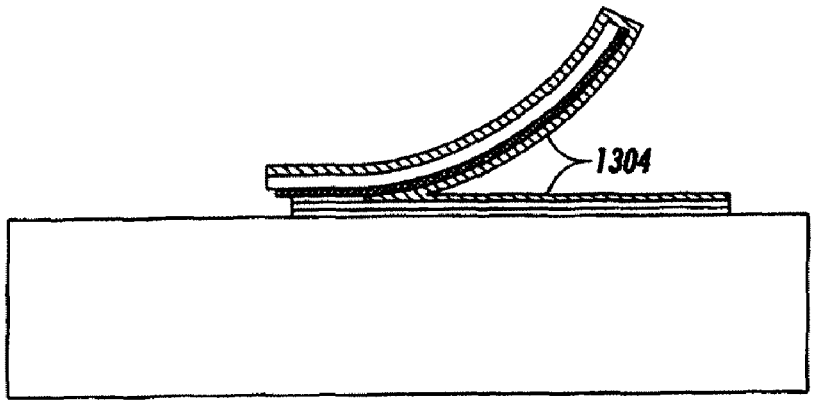

FIGS. 10-13 show an alternative spring structure wherein a cementation layer 1004 and adhesion layer 1008 are deposited prior to release layer 104 and substrate 100 deposition. Cementation layer 1004 is typically gold (Au) or nickel (Ni) and the adhesion layer may typically be Mo, MoCr, Ti, or Cr. FIG. 13 shows cementation layer 1004 enabling selective deposition of metal 1304 under the spring. Metal 1304 enables a stronger anchoring of the spring to the substrate as well as a higher spring constant.

Figure 10:
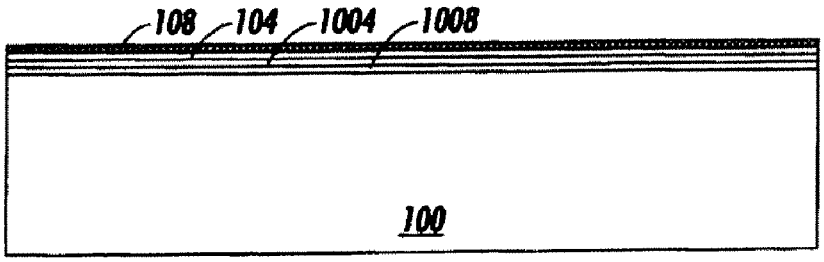
FIGS. 10-13 show the use of an optional adhesion and cementation layer underneath the release layer.

The process of forming a cementation and adhesion layer under a spring approximately follows the process illustrated in FIGS. 1-5 except that initially, a cementation layer 1004 and adhesion layer 1008 is deposited between release layer 104 and substrate 100 as shown in FIG. 10. FIG. 11 shows the spring structure that results after a series of processing operations similar to that described in FIG. 2 through FIG. 5. Those processing operations include removal of a portion of release layer 104 thereby exposing the cementation layer and adhesion layers. FIG. 12 shows the exposed cementation layer 1004 adhering to cladding material in the region immediately underneath the spring. FIG. 13 shows the final structure after resist stripping and clear etch of the seed and release layers.

Figure 14:
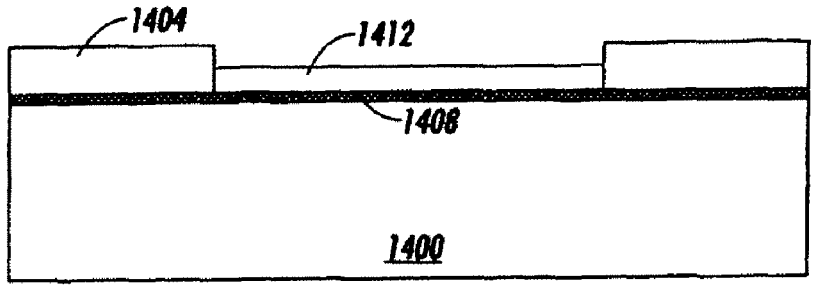
FIG. 14 shows a front cross sectional view of a spring prior to exposure to an etchant.

FIGS. 14-18 shows a front cross sectional view of an example spring formation process. FIG. 14 shows a resist material 1404 deposited over a combination release and seed layer 1408. Resist material 1404 is typically deposited using a photolithographic process. Once deposited, the resist serves as a mask, usually a hard mask that defines spring material 1412 deposition. As previously described, the spring material is typically deposited such that metal density gradually decreases as distance from substrate 1400 increases. The changing density helps produce the internal stress gradient.

Figure 15:
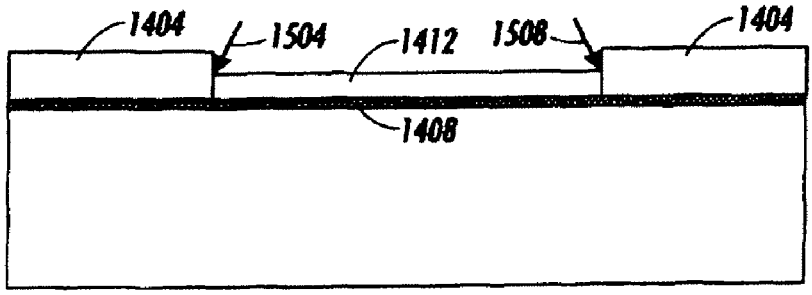
FIGS. 15-16 show the front cross sectional view of FIG. 5 as an etchant penetrates the interface between a spring material and a surrounding mask material.

FIG. 15 shows exposing resist material 1404 and seed layer 1408 to an interface penetrating etch. Arrows 1504, 1508 indicate where the etchant passes between resist material 1404 and spring material 1412. The etchant may penetrate this interface due to the loose contact between resist material 1404 and spring material 1412. Alternatively, the etchant might overcome the adhesion forces between the resist material and the spring material. In one embodiment, a "natural gap" of less than 20 microns naturally forms between spring material 1412 and resist material 1404 during device fabrication facilitating the flow of etchant between the resist and spring interface. One mechanism for the formation of a gap is through the shrinkage of the resist after plating. This can occur by a variety of means. For example, the resist can undergo a physical change such as drying, the loss of solvent, etc. The resist can also shrink relative to the metal simply by virtue of its comparatively larger temperature coefficient of expansion relative to the substrate and the plated material. If the interface between the plated material and the resist is not strongly bonded, it will not support very much tensile stress, and will open up a gap of nanometer scale dimensions with only minor amounts of shrinkage. This effect can be augmented by depositing the plated material at an elevated temperature relative to the release etch. Further, gap widening can be enhanced by using an additional plasma etching step (e.g. oxygen (O2) plasma) which isotropically etches the photoresist but does not attack metal.

Figure 16:
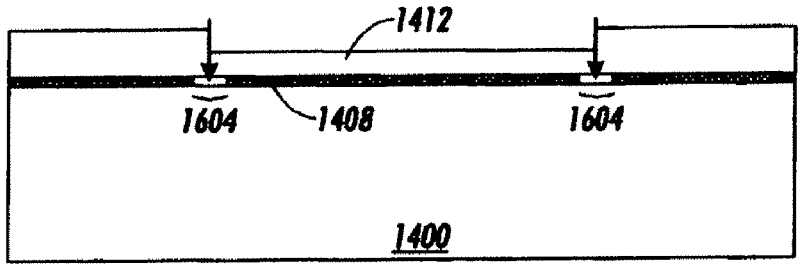
Figure 17:
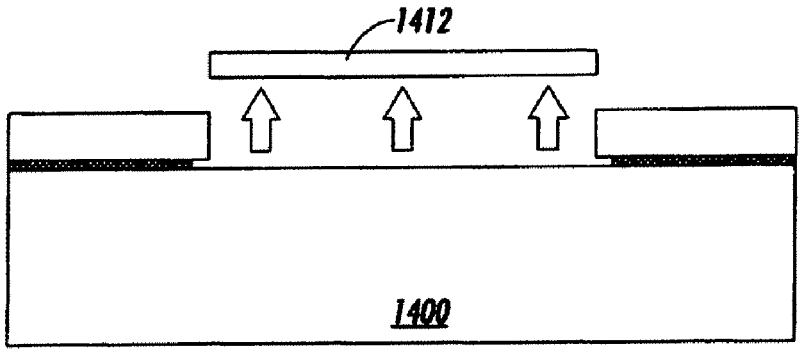
FIG. 17 shows the front cross sectional view of FIG. 5 after the etchant releases the spring from the substrate.
Figure 18:
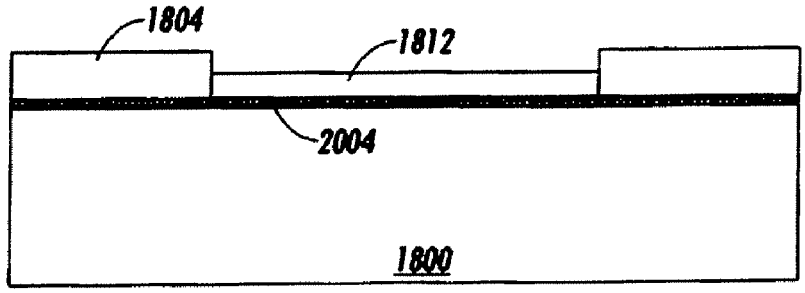
FIGS. 18-21 show the process used in FIGS. 14-17 when the rate of etching is enhanced by a gap widening etch that increases the size of a gap between the mask and the spring material.

FIG. 16 shows the beginning stages of etching the combination release and seed layer 1408. The etching produces gaps 1604 in the release and seed layer 1408 immediately under the resist-spring interface region. The gap in the release layer soon exceeds the size of any natural gap that may exist at the resist spring interface. Over time, the release and seed layer 1408 under spring material 1412 is completely etched away. Upon complete removal of the release and seed layer 1408 underneath spring material 1412, the internal stress gradient uplifts spring material 1412 as shown in FIG. 17.

Figure 19:
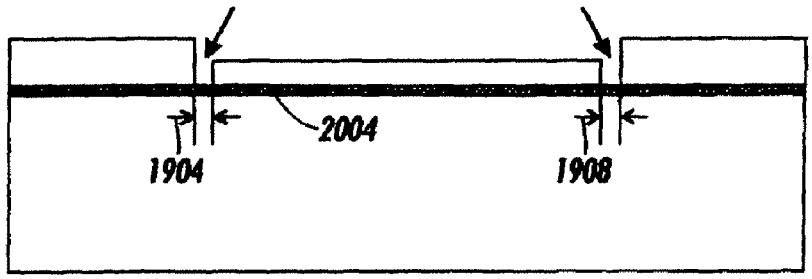
Figure 20:
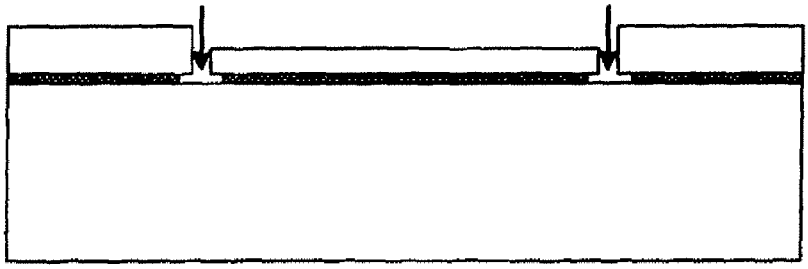
Figure 21:
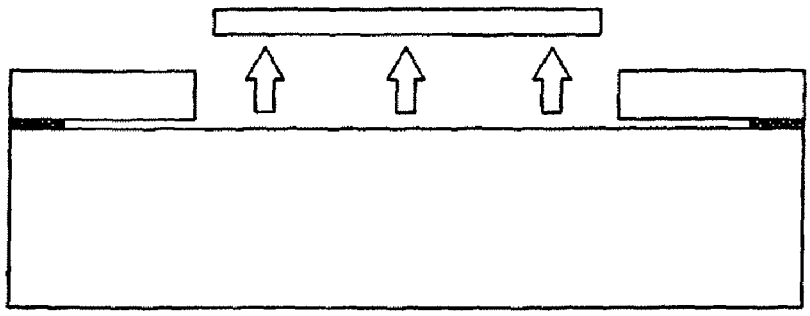

FIGS. 18-21 show a process similar to the process of FIGS. 14-17 except that a gap widening etch facilitates the interface penetrating etch. In FIG. 19, a gap widening etch such as oxygen (O2) plasma is used to create or widen a gap 1904, 1908 between the spring and the resist material. In an alternate implementation, exposure to rapid temperature changes produces different expansion rates in different materials. In particular, rapid temperature changes induce different expansions of the mask and the spring material resulting in expanding of the gap between the mask and the spring material. Larger mask/spring material gaps facilitate etchant flow to the release and seed layer 2004. Eventually the release and seed layers underneath the spring are etched away allowing spring release in FIG. 21.

Figure 22:
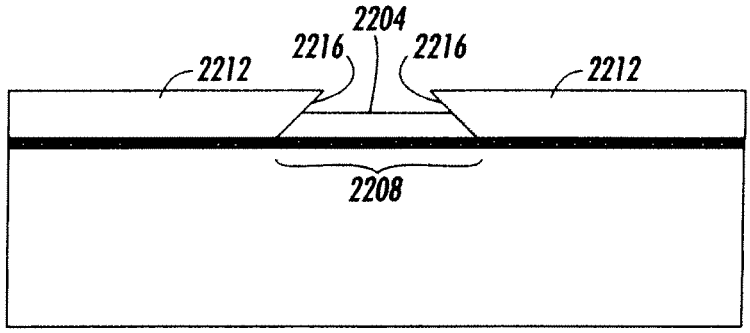
FIGS. 22-24 show the use of a negative side profile resist to delay spring uplift.
Figure 23:
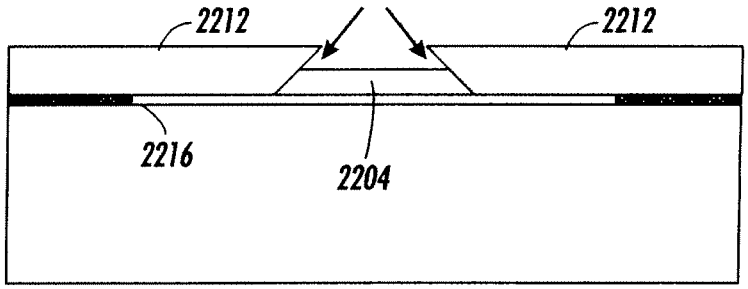
Figure 24:
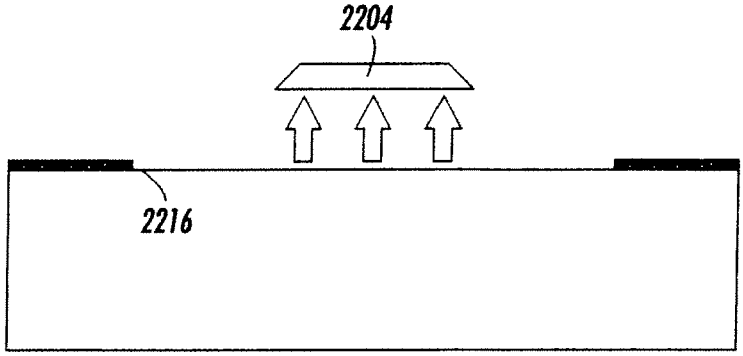

During device fabrication, it is sometimes preferable to delay spring uplift or "pop-up" until a later time in device processing. For example, when springs are formed as interconnects on a wafer, handling a smooth wafer substrate is simpler then handling a wafer substrate with uplifted spring surfaces. In such cases, FIGS. 22-24 show a structure that delays spring uplift using a negative side resist profile at the resist and spring material interface. FIG. 22 shows depositing a stressed metal spring material 2204 in resist gap 2208. Resist side walls 2216 form a negative profile, such a negative side profile may be achieved by various techniques such as the use of negative resist, or through a resist image reversal process. Spring material 2204 forms a complimentary positive profile interface that matches the negative side profile where spring material 2204 is wider at a base and narrows toward a top layer of the spring material.

In FIG. 23, an interface penetrating etch penetrates spring material 2204/resist 2212 interface removing release and seed layer material 2216 under spring material 2204. After release layer removal, an internal stress gradient provides an uplift force that tends to lift spring material 2204. The negative profile interface along resist 2212 edge counters the uplift force and keeps down spring material 2204. When uplift is desired, the resist is removed in FIG. 24 allowing the internal stress gradient to uplift spring material 2204.

Figure 25:
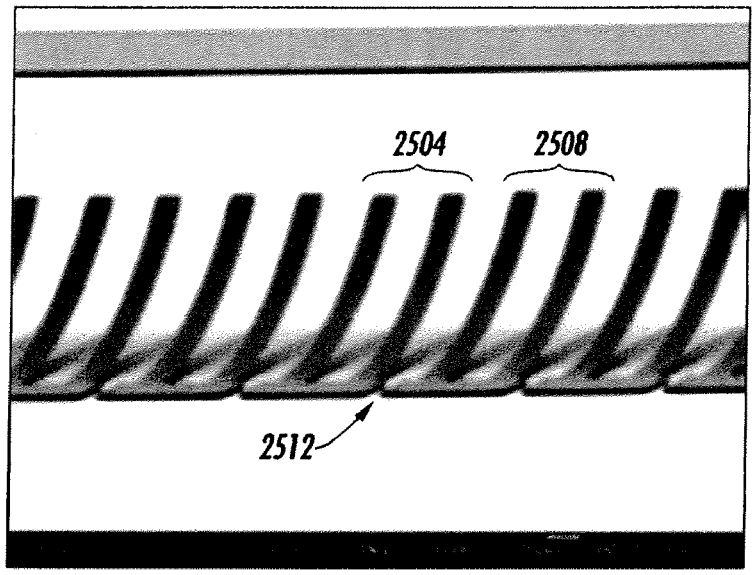
FIG. 25 shows a side schematic view of example resulting spring structures.

FIG. 25 shows an example array of spring structures 2504, 2508 formed by the described methods. Anchor region 2512 of each spring formed by the described single step lithography method is typically larger than traditional stressed metal spring anchors. Larger anchors prevent the etch that undercuts and releases the uplift portion of the spring from undercutting the entire anchor region.

Figure 26:
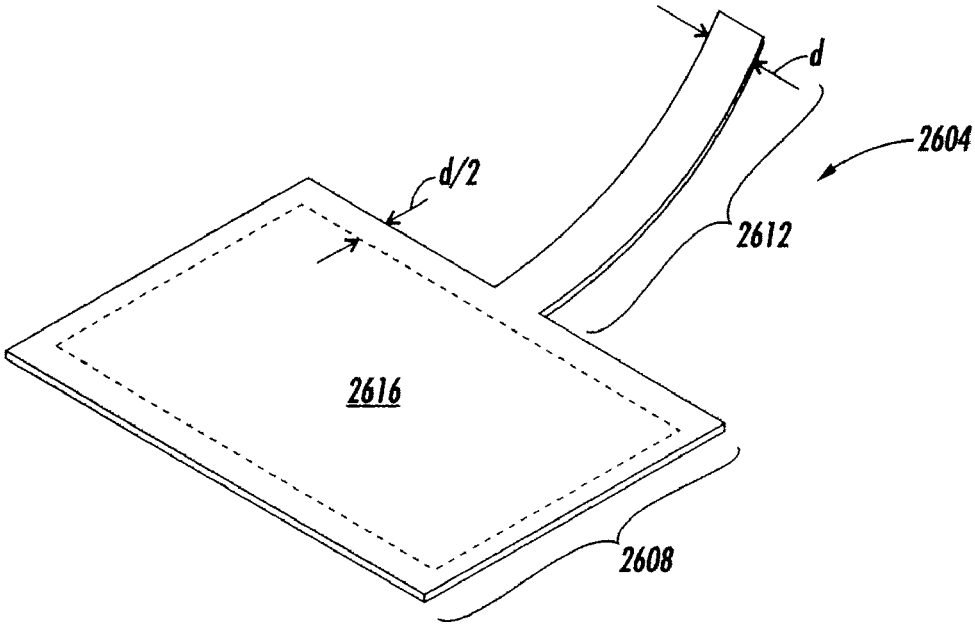
FIG. 26 shows a top view of the spring and anchor region with the unreleased portion of the anchor outlined.

FIG. 26 shows a schematic view of an example spring 2604 including an anchor region 2608 and a release or uplift region 2612. In order to allow complete undercutting of the release region while not completely undercutting the anchor region, the distance from the anchor region center to the nearest anchor region edge should be substantially greater than the distance from any point in the release region to the nearest release region edge. Typically, after release of the uplift portion, only a subset region, attached anchor release layer 2616 of spring anchor 2608, remains bonded to the underlying substrate. Thus, when distance "d" represents the widest portion of release region 2612 and when a minimal interface penetrating etch releases the release region 2612, the outer perimeter of attached spring anchor 2608 is typically at least a distance d/2 from the resist-spring interface. Another way to look at it is that the spring anchor 2608 perimeter extends approximately d/2 beyond the anchor release layer 2616 perimeter.

Although the spring dimensions may vary considerably, one typical use for the spring structure is to interconnect integrated circuit elements. Thus the springs are typically quite small. Typical dimensions for "d" are often less than 200 microns. Typical spring lengths are less than 1000 microns.

Figure 27:
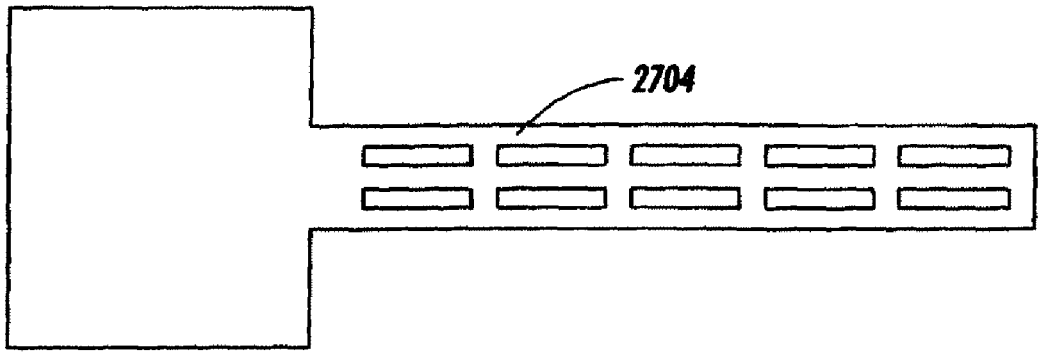
FIGS. 27-28 show perforating the release region to facilitate etching the release layer underneath the spring release region.
Figure 28:
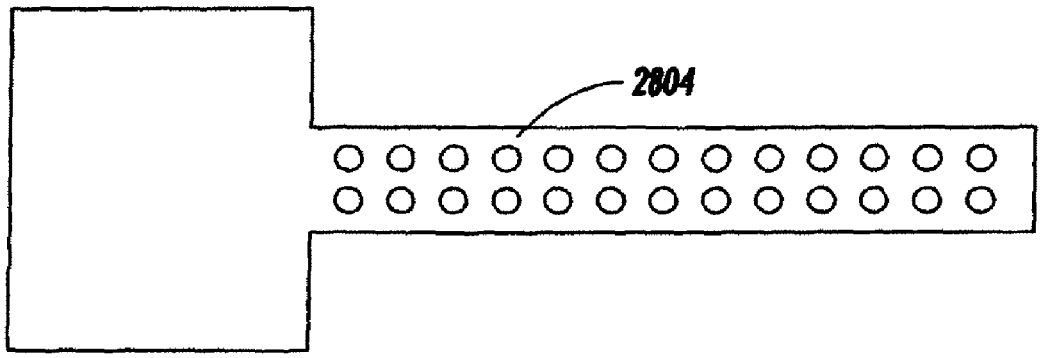

When smaller anchors are desired, (or faster release times needed), perforations incorporated into the spring release portion facilitates the etch process. FIG. 27 shows a rectangular perforation 2704 in a spring release portion while FIG. 28 shows circular perforations 2804 in a similar spring release portion.

Figure 29:
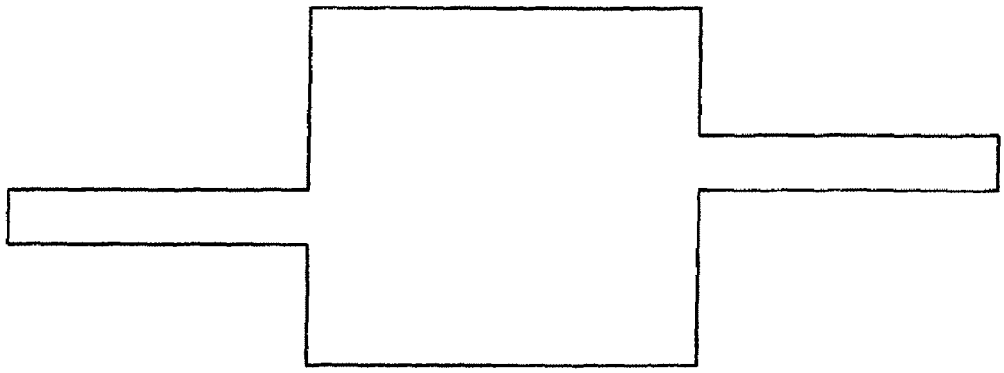
FIGS. 29-30 show alternate spring structure patterns.
Figure 30:
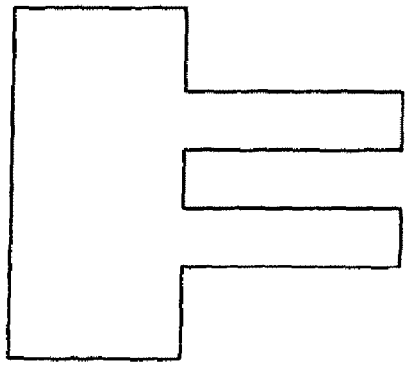

FIGS. 29 and 30 show alternate spring structures although many other shapes will come to those of ordinary skill in the art. The one common criterion of the various shapes is that a larger wider region of the structure serves as a spring anchor and one or more narrower and longer regions of the structure serve as springs.

The preceding specification includes numerous examples and details such as geometries, materials used and the like. Such examples and details are provided to facilitate understand of the invention and its various embodiments and should not be interpreted to limit the invention. Instead, the invention should only be limited by the claims, as originally presented and as they may be amended, to encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. An intermediate structure for forming a stressed metal spring structure, the intermediate structure comprising:
- a substrate having a surface,
- a release/seed layer disposed on the substrate surface;
- a resist material mask disposed on the release/seed layer, the resist material mask defining an opening and having a peripheral resist edge that surrounds the opening;
- a spring material structure formed inside the opening such that a perimeter edge of the entire spring material structure is disposed inside of the peripheral resist edge and the spring material structure is disposed on a portion of the release/seed layer such that an interface gap is formed between the perimeter edge of the spring material structure and the peripheral resist edge,
- wherein the release/seed layer defines a cavity located below the interface gap and disposed around an entirety of the perimeter edge of the spring material structure, and wherein the cavity extends underneath a portion of the spring material structure.

2. The intermediate structure of claim 1, wherein a distance across the interface gap between the perimeter edge of the spring material structure and the peripheral resist edge is less than 20 microns.

3. The intermediate structure of claim 1, wherein the spring material structure includes an internal stress gradient.

4. The intermediate structure of claim 1, wherein the release/seed layer comprises a seed layer formed on a release layer.

5. An intermediate structure for forming a stressed metal spring structure, the intermediate structure comprising:
- a substrate having a surface,
- a release/seed layer disposed on the substrate surface;
- a resist material mask disposed on the release/seed layer, the resist material mask defining an opening and having a peripheral resist edge that surrounds the opening;
- a spring material formed in the opening and on a portion of the release/seed layer such that an interface gap is formed between a perimeter of the spring material and the peripheral resist edge,
- wherein the peripheral resist edge has a negative side profile.

6. A spring structure comprising:
- a planar substrate;
- a release layer portion fixedly attached to the planar substrate; and
- a spring including:
- an anchor portion disposed on the release layer portion such that the anchor portion is fixedly attached to the planar substrate by said release layer portion; and a release portion extending from a peripheral edge of the anchor portion and bending away from the planar substrate, wherein a peripheral edge of the anchor portion extends beyond a perimeter of the release layer portion such that an undercut region is defined under an entirety of the peripheral edge of the anchor portion.

7. The spring structure according to claim 6, wherein the release portion of the spring has a width "d", and wherein the undercut region defined between the perimeter of the release layer portion and the peripheral edge of the anchor portion is greater than one-half of the width "d".

8. The spring structure according to claim 7, wherein a distance from the center of the anchor portion to a point on the peripheral edge nearest to the center is greater than the width "d".

* * * * *